US011060319B2

(12) United States Patent
Youngblut

(10) Patent No.: US 11,060,319 B2
(45) Date of Patent: Jul. 13, 2021

(54) SHELTER ASSEMBLY

(71) Applicant: Darrin Youngblut, Jesep, IA (US)

(72) Inventor: Darrin Youngblut, Jesep, IA (US)

( * ) Notice: Subject to any disclaimer, the term of this patent is extended or adjusted under 35 U.S.C. 154(b) by 0 days.

(21) Appl. No.: 16/532,158

(22) Filed: Aug. 5, 2019

(65) Prior Publication Data

US 2021/0040767 A1 Feb. 11, 2021

(51) Int. Cl.
*E04H 15/58* (2006.01)
*E04H 15/00* (2006.01)
*E04H 15/44* (2006.01)

(52) U.S. Cl.
CPC ..... *E04H 15/58* (2013.01); *E04H 15/001* (2013.01); *E04H 15/44* (2013.01)

(58) Field of Classification Search
CPC ..... E04H 15/58; E04H 15/54; E04H 15/14; E04H 15/001
USPC ..... 135/117
See application file for complete search history.

(56) References Cited

U.S. PATENT DOCUMENTS 1,045,132 A * 11/1912 Dorsey ..... E04H 15/32 135/117
2,069,479 A * 2/1937 Pluth ..... E04H 15/00 135/115
2,928,404 A * 3/1960 Klages ..... E04H 15/322 135/98
3,008,477 A * 11/1961 Bester ..... E04H 15/001 135/139
3,011,824 A * 12/1961 Vassallo ..... B62B 9/14 296/102
3,136,356 A * 6/1964 Mears ..... E06B 3/80 160/87
3,148,688 A * 9/1964 Arnopole ..... E04H 15/14 135/117
3,782,399 A * 1/1974 Milner ..... E04H 15/32 135/117
6,354,355 B1 * 3/2002 Ragouzis ..... B60J 1/08 160/368.1
6,962,188 B2 * 11/2005 Coenraets ..... A62C 2/10 160/180
8,066,022 B2 * 11/2011 Schlipf ..... E04H 15/001 135/147
8,776,814 B1 * 7/2014 Beam ..... E04H 15/44 135/115
9,788,537 B1 * 10/2017 Goulet ..... E04H 15/14
9,890,552 B2 * 2/2018 Schneider ..... E04H 15/001
10,584,511 B1 * 3/2020 Slaughter ..... E04H 15/56

* cited by examiner

*Primary Examiner* — Noah Chandler Hawk
(74) *Attorney, Agent, or Firm* — Messner Reeves LLP

(57) ABSTRACT

A collapsible shelter is provided herein. The collapsible shelter may include a frame. A cover is disposed over the frame and defines a window. First and second flaps are each operably coupled with the cover and configured to extend over separate portions of the window. A retaining device has a first portion disposed on the first flap and a second portion disposed on the second flap. The first and second portions are configured to engage one another. An elongated member is disposed within the first and second flaps and is configured to retain the first and second flaps in a non-linear position.

17 Claims, 5 Drawing Sheets

SHELTER ASSEMBLY

FIELD OF THE DISCLOSURE

The present disclosure generally relates to a shelter or blind.

BACKGROUND OF THE DISCLOSURE

Shelters and/or blinds can provide hunters or campers with temporary shelter and protection from the elements and generally include a structural component and an enclosure supported by the structural component. In some instances, it may be desired to have a better shelter for accommodating various activities while utilizing the shelter or blind.

SUMMARY OF THE DISCLOSURE

According to some examples of the present disclosure, a collapsible shelter is provided herein. The shelter includes a frame. A cover is disposed over the frame and defines a window. First and second flaps are each operably coupled with the cover and are configured to extend over separate portions of the window. A retaining device has a first portion disposed on the first flap and a second portion disposed on the second flap. The first and second portions are configured to engage one another. An elongated member is disposed within the first and second flaps and is configured to retain the first and second flaps in a non-linear position.

According to some examples of the present disclosure, a collapsible shelter is provided herein. The shelter includes a cover disposed over a frame. The cover defines a window. A first flap is operably coupled with the cover through a fastening assembly. A retaining device is configured to maintain the first flap in respective open and closed positions. A bendable, elongated member is disposed within the first flap and is configured to retain the first flap in a substantially defined position.

According to some examples of the present disclosure, a shelter is provided herein. The shelter includes a cover disposed over a frame. The cover defines a window. First and second flaps are operably coupled with the cover through a fastening assembly. A bendable, elongated member is disposed within the first and second flaps and is configured to retain the first and second flaps in a substantially defined position.

These and other aspects, objects, and features of the present invention will be understood and appreciated by those skilled in the art upon studying the following specification, claims, and appended drawings.

DETAILED DESCRIPTION

Figure 1A:
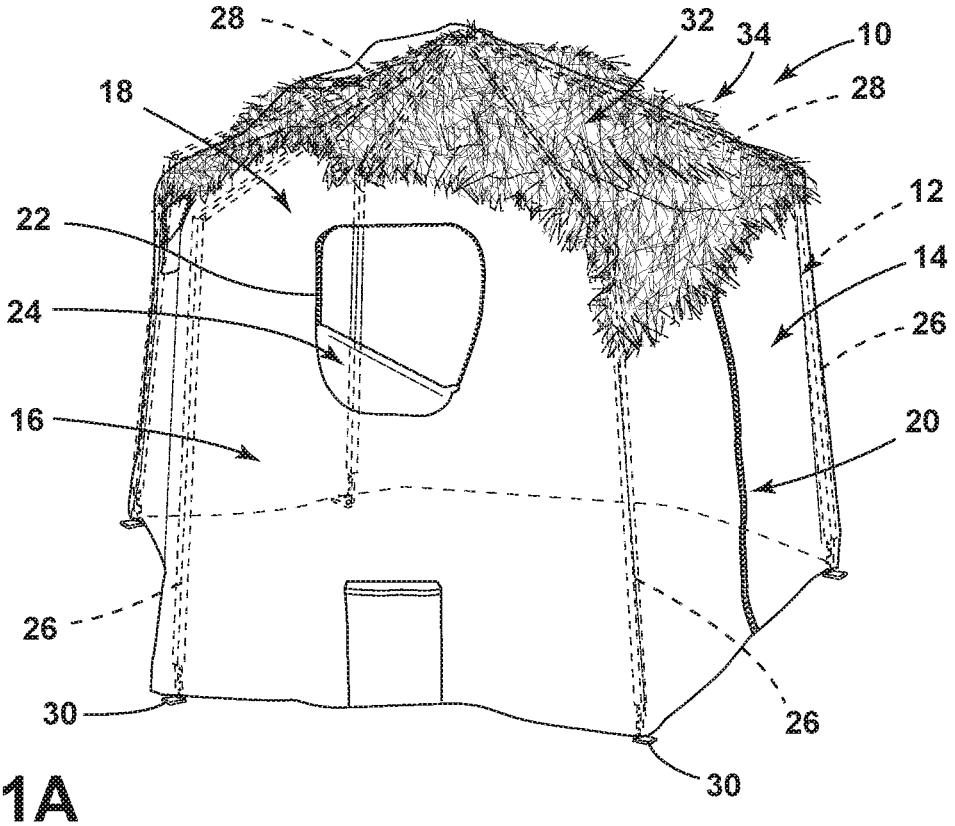
FIG. 1A is a front perspective view of a shelter having a cover disposed over a frame and a window defined by the cover, according to some examples.

For purposes of description herein, the terms "upper," "lower," "right," "left," "rear," "front," "vertical," "horizontal," and derivatives thereof shall relate to the example of FIG. 1A. However, it is to be understood that the assembly provided herein may assume various alternative orientations, except where expressly specified to the contrary. It is also to be understood that the specific devices and processes illustrated in the attached drawings, and described in the following specification are simply exemplary examples of the inventive concepts defined in the appended claims. Hence, specific dimensions and other physical characteristics relating to the examples disclosed herein are not to be considered as limiting, unless the claims expressly state otherwise.

As required, examples of the present invention are disclosed herein. However, it is to be understood that the disclosed examples are merely exemplary of the invention that may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present invention.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

As used herein, the term "and/or," when used in a list of two or more items, means that any one of the listed items can be employed by itself, or any combination of two or more of the listed items can be employed. For example, if a composition or assembly is described as containing components A, B, and/or C, the composition or assembly can contain A alone; B alone; C alone; A and B in combination; A and C in combination; B and C in combination; or A, B, and C in combination.

The following disclosure describes a collapsible shelter. The collapsible shelter may include a frame. A cover is disposed over the frame and can define a window. First and second flaps can be operably coupled with the cover and configured to extend over separate portions of the window. A retaining device may have a first portion disposed on the first flap and a second portion disposed on the second flap. The first and second portions may be configured to engage one another. An elongated member can be disposed within the first and second flaps and can be configured to retain the first and second flaps in a non-linear position.

Referring to FIGS. 1A-3, a shelter 10, according to some examples, generally includes a collapsible frame 12 and a flexible cover 14. The shelter 10 may be collapsible from an expanded or extended position that defines an interior space for a user to reside (see FIG. 1A), to a collapsed or retracted position to provide ease of transport of the shelter 10.

Figure 3:
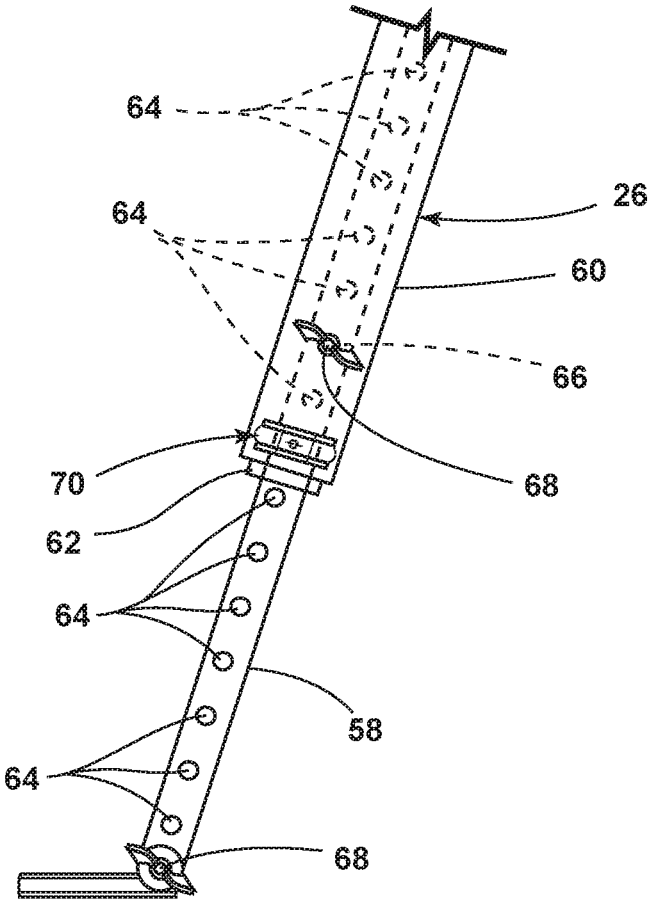
FIG. 3 is an enhanced view of area III of FIG. 1B, according to some examples.

The frame 12 may include one or more generally vertically oriented legs 26 and one or more cross beams 28 that interconnect the legs 26. In some examples, one of which is illustrated in FIG. 3, a length of each leg 26 may be independently adjustable such that the frame 12 sets level on various terrains. In some examples, each leg 26 may include a lower support 58 and an upper support 60. A collar 62 may be positioned at the bottom end portion of the upper support 60 and configured to retain the lower support 58 in a predefined orientation relative to the upper support 60. The lower support 58 may have a cross section that is smaller than the upper support 60 such that a portion of the lower support 58 may be slidably engaged with the upper support 60. The lower support 58 may also define a plurality of apertures 64 disposed there along at predefined distances. The upper support 60 may include an engagement void 66 that can align with one or more of the apertures 64 as the lower support 58 is slid within the upper support 60. Once set at a desired height, a locking pin 68 may be inserted through the void and at least one of the plurality of apertures 64 thereby locking the leg 26 at a desired length.

In some instances, a leveling indicator 70, such as a leveling bubble, can be built into the frame 12 components to further aid in leveling the shelter 10 on sloping terrain. The leveling indicator 70 may be formed from a tube having a liquid therein. The tube may include a pair of indicators. When the leveling bubble is disposed between the pair of indicators, the leg 26 may be generally level relative to a direction that is perpendicular to the tube. In some examples, any other type of leveling indicator may be used in conjunction with or instead of the leveling bubbles.

Figure 1B:
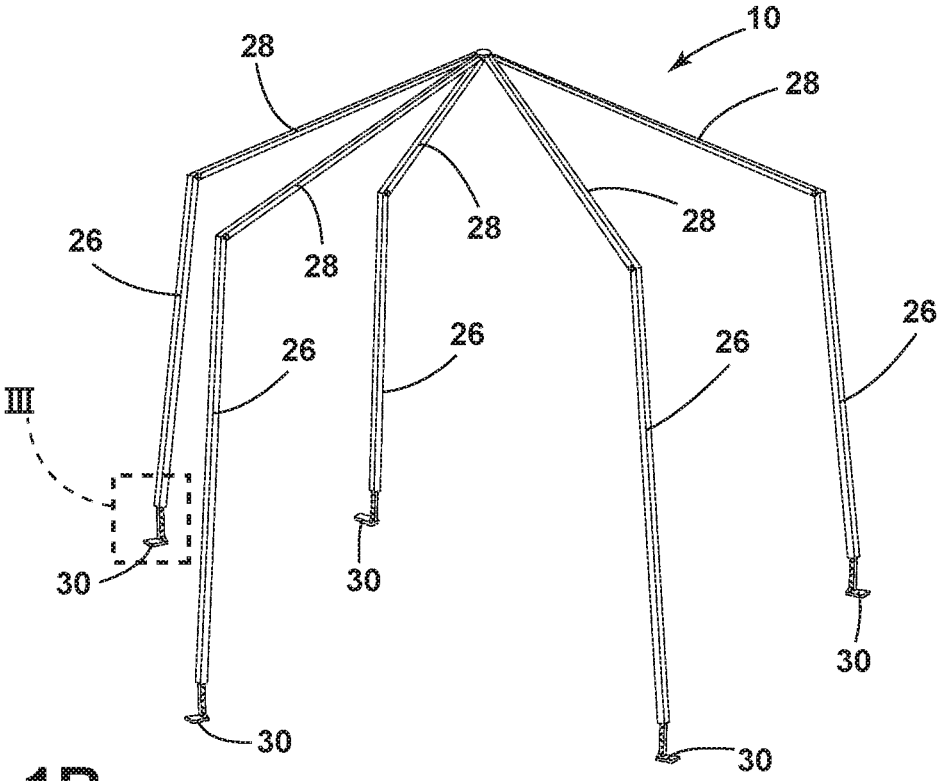
FIG. 1B is a front perspective view of the frame of the shelter, according to some examples.
Figure 2:
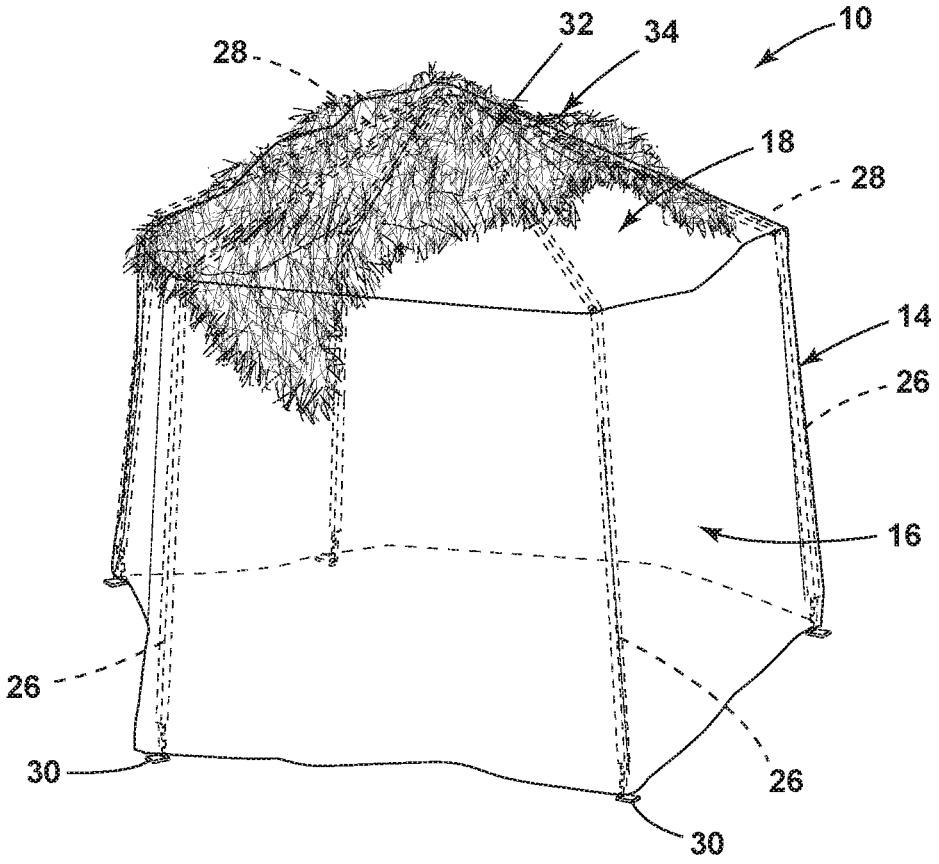
FIG. 2 is a rear perspective view of the shelter having an exterior layer positioned on the cover, according to some examples.

The frame 12, or various components thereof, may be formed from a polymeric material, a metallic material, and/or any other practicable material. Moreover, although FIGS. 1A-2 depict examples in which five legs 26 are employed, it will be appreciated that other examples may employ any sized polygonal frame 12.

With continuing reference to FIGS. 1A-3, feet 30 may extend from each respective leg 26 in an offset direction from each leg 26 to further stabilize the frame 12 in the expanded position. A hinge mechanism may be on the bottom of the adjustable height leg 26 that allows the foot 30 to be pivoted through a wide range of angles. Furthermore, the movable foot 30 may be sufficiently wide so to provide stability in soggy ground, and can be equipped with a high-traction surface, such as a rubber tread, for improved traction on sloping surfaces.

In various examples, the cover 14 may generally define side walls 16 of the shelter 10. The cover 14 may include one or more roof panel(s) 18 defining a roof of the shelter 10. The cover 14 may further define a floor (not shown) of the shelter 10, or the shelter 10 may further include a flexible floor member (not shown) attached to or integral with the cover 14. Access to and from the interior of the shelter 10 is provided through a door 20 disposed on the cover 14 and/or defined by the cover 14 alone or in cooperation with other structures disposed on the cover 14. For example, a portion of the cover 14 defining one of the side walls 16 may comprise a slit extending from the bottom of the cover 14 to a point approximate the adjacent roof panel 18; a zipper or another suitable fastening assembly may be disposed across the slit and may be operable to open and close the door. As seen in FIG. 1A, the side walls 16 can define one or more windows 22, which may include see-through mesh panels, for visibility and ventilation. The location(s) of the windows 22 in the cover 14 can vary, and example locations are shown in FIGS. 1A-3. For example, in the embodiment of FIG. 2, the window 22 is arranged in a generally upper central portion of a side walls 16 of the cover 14. It will be recognized that other window 22 locations and configurations are also within the scope of the present disclosure. Flaps 24 can be closed to cover 14 and/or conceal portions of the windows 22. In various configurations, a window 22 can have one corresponding flap 24 or multiple corresponding flaps 24 for covering the window 22; and, a flap 24 can correspond to (i.e., cover all or a portion of) a single window 22 or multiple adjacent windows 22.

The cover 14 may be formed from any practicable material including a fabric (e.g., nylon, canvas, etc.), an elastomeric material, a polymeric material, and/or the like that provide, for example, flexibility, elasticity, wear resistance, strength, durability and other desired properties. Patterns such as a camouflage pattern that simulates the appearance of at least some of the local environment may be provided on the cover 14. Wildlife may be startled by foreign objects, such as shelters 10, which have not traditionally been present in a given location where wildlife animals are used to frequenting (e.g., a water hole or a game trail). Camouflaging the shelter 10 may, however, reduce the "unnatural" appearance of the shelter 10 and reduce its startle effect on wildlife animals.

With further reference to FIGS. 1A-2, in some examples, an exterior layer 32 can be disposed on the cover 14. The exterior layer 32 can be printed with a desired pattern or design that is the same as or different from the cover 14. The exterior layer 32 can be employed to alter the appearance of the shelter 10 based on environmental conditions, e.g. an exterior layer 32 printed with a camouflage pattern appropriate for a grassy field or a desert terrain can be applied when hunting in such conditions to hide or change the appearance of the shelter 10. The exterior layer 32 can also add to or enhance a camouflage pattern printed on the cover 14. For example, the exterior layer 32 might include a plurality of threads, slits, cutouts, or loosely attached portions that can form a Ghillie camouflage pattern or any other three-dimensional camouflage pattern. Any three-dimensional pattern on the shelter assembly 10 can be formed from an integrated assembly or be formed by a user through one or more assembly steps.

In some examples, the exterior layer 32 can additionally or alternatively be configured to provide weather resistance qualities like waterproofing or windproofing such that the shelter 10 can be employed to protect the user from such weather conditions. In such examples, the exterior layer 32, or components thereof, water-repelling properties to can assist in avoiding water retention issues, which may lead to increased weight, as well as avoiding mildew or decomposition issues, which may lead to degradation or rot of the shelter assembly 10.

In examples in which the exterior layer 32 includes Ghillie camouflage pattern, the Ghillie fabric may include a face of protruding yarns 34 that are sewn to a base fabric. The base fabric may be any practicable material, such as a polyester-based material, or any other practicable material having at least some hydrophobic properties. The yarn 34 may be attached to the fabric in a predefined or randomized pattern. A user may attach objects to the exterior layer 32, or the strands of the yarn 34, once the exterior layer 32 is secured to the shelter 10. Example objects that may be attached to the shelter 10 include, for example, branches, leaves, and/or grass. The objects may be held in a place by the protruding yarns 34, any other feature of the exterior layer 32, and/or the cover 14. In various examples, the exterior layer 32 may be used to cover different portions of the shelter 10. In the example illustrated in FIGS. 1A-2, the exterior layer 32 is used to cover a portion of the roof panel(s) 18 and side walls 16. In some examples, the exterior layer 32 may be sized to extend completely over at least one of the side walls 16 of the shelter 10. Additionally or alternatively, in some configurations, the exterior layer 32 may cover substantial portions of an outer surface of the shelter 10 such as, for example, the entire roof panel(s) 18 and at least half of one or more side walls 16, or substantially all of a periphery of the shelter 10 defined by the side walls 16 and at least portions of the roof panel(s) 18.

Figure 4:
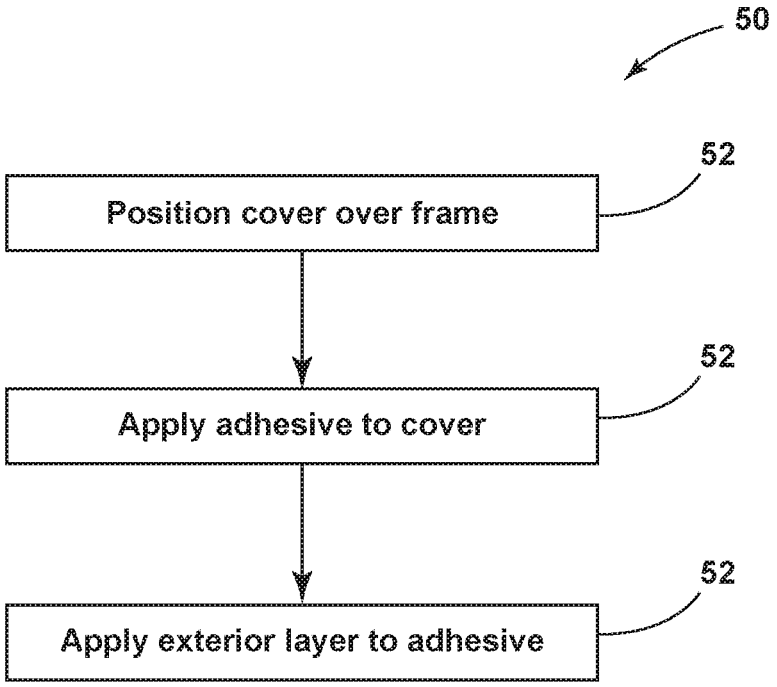
FIG. 4 is a method of applying the exterior layer to the cover, according to some examples.

Referring to FIG. 4, a method 50 of camouflaging a ground blind is illustrated according to some examples. At step 52, the cover 14 may be disposed over the frame 12. Next, at step 54, an adhesive may be applied to the cover 14. The adhesive may be any material, assembly, or compound that allows for further attachment of objects thereto. At step 56, the exterior layer 32 may be positioned on and retained by the adhesive. In various examples, the exterior layer 32 may be a loose material that is composed of manufactured products, such as thread or fabric, and/or environmentally produced products, such as leaves, grass, sticks, and so on.

Figure 5:
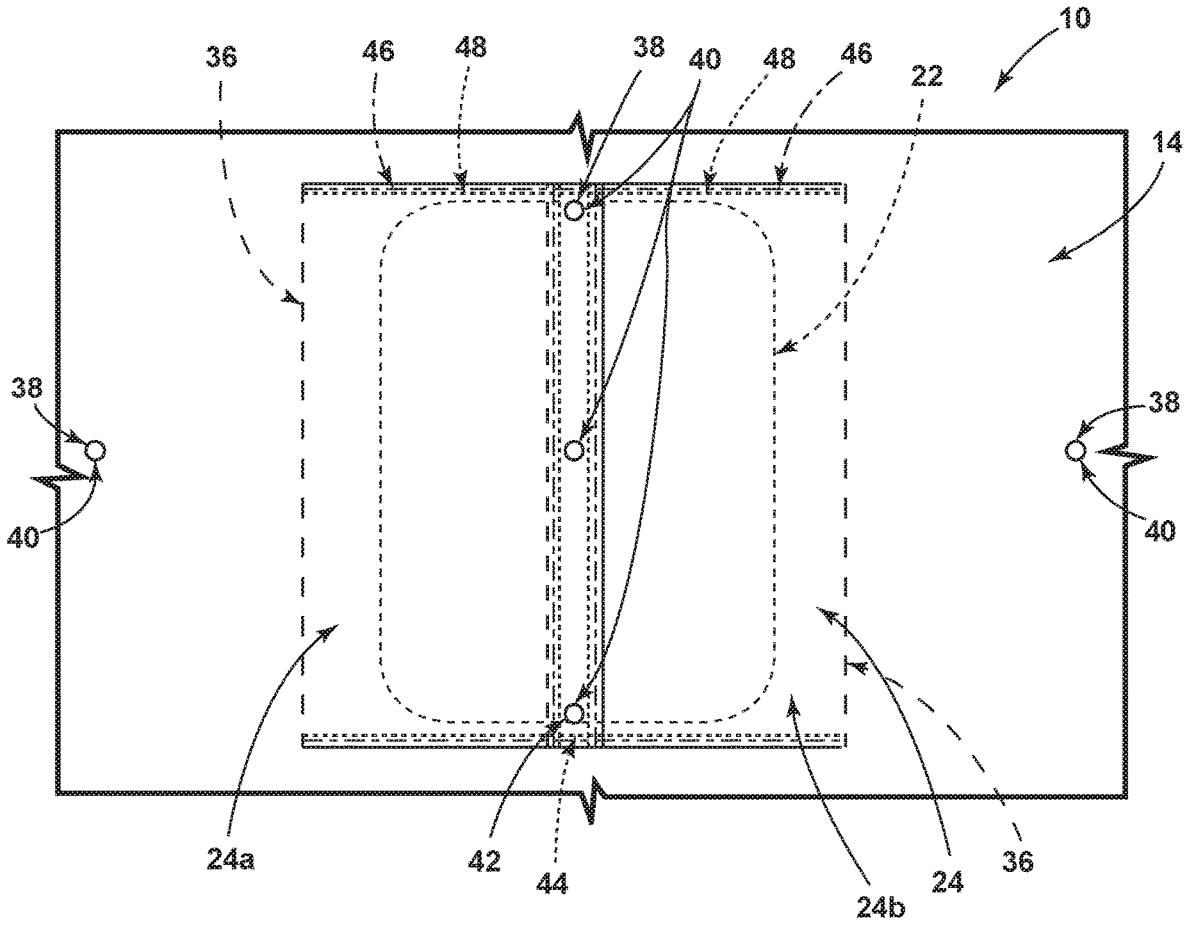
FIG. 5 is a perspective view of an interior surface of the window defined by the cover and a pair of flaps disposed over the window, according to some examples.

One or more flaps may be utilized to cover the window. For example, as illustrated in FIG. 5, flaps 24 may be made from a similar material to that of the cover 14 and/or the exterior layer 32. Or, in some instances, the one or more flaps 24 may be formed of a varied material from that of the cover 14 or exterior layer 32. In some examples, the flaps 24 and at least a portion of the cover 14 include an exterior layer 32 having a common camouflage pattern thereon. For example, the exterior layer 32, which may include a Ghillie camouflage pattern, may be disposed on and/or form one or more of the flaps 24. In some examples, a fastening assembly 36 can be used for attaching first and second flaps 24*a*, 24*b* to various lateral and/or vertical sides of the window 22 on an interior surface of the cover 14. The flaps 24 may additionally or alternatively be attached to an exterior surface of the cover 14 and/or the exterior layer 32. In various examples, the fastening assembly 36 may operably and/or removably couple the first or second flap 24*a*, 24*b* to the cover 14 (or the exterior layer 32) through any known fastening assembly 36, such as a thread, a yarn, an adhesive, a zipper, a hook and loop fastener, a magnet, a snap, and/or other fastening assemblies. In some instances, the fastening assembly 36 may removably couple the first and second flaps 24*a*, 24*b* to the cover 14 through a first section on the first and second flaps 24*a*, 24*b* and a second section on the cover 14. For example, the first section may include a magnet and the second section may include a ferromagnetic material that is attracted to the magnet. The magnet may be in either the first and/or second section. Similarly, the first or second section may include a hook and the other of the first or second section may include a loop for attaching to one another. Each of the flaps 24 may be cantilevered over at least a portion of an opening of the window 22 to provide privacy and/or prevent rain, dust and the like from entering the shelter 10 through the window 22.

In some examples, a retaining device 38, such as, clips, brackets, buckles, hooks, cords, loops, buttons, snaps 40, straps, or other features, may be positioned on the flaps 24 and/or the cover 14 for maintaining the flaps 24 in an open and/or closed position. For example, as illustrated in FIG. 5, the first and second flaps 24*a*, 24*b* may overlap in the closed position. The retaining device 38 may include a first portion 42 having one or more snaps 40 positioned on the first flap 24*a* and a second portion 44 having one or more snaps 40 on the second flap 24*b* for maintaining the first flap 24*a* in a substantially fixed relationship relative to the second flap 24*a*. The snaps 40 positioned on the first and second flaps 24*a*, 24*b* may be vertically aligned to further retain the flaps 24*a*, 24*b* in contact with one another. Additionally or alternatively, the retaining device 38 may include a third portion having one or more snaps 40 positioned on the cover 14. The snaps 40 on the flaps 24*a*, 24*b* may releasably couple with the snaps 40 on the cover 14 to maintain the flaps 24*a*, 24*b* in an open position. In some examples, the first portion 42 of the retaining device 38 is configured to couple with the second portion 44 to place the first flap 24*a* in a closed position and with the third portion to place the first flap 24*a* in an open position.

Referring still to FIG. 5, in some examples, the flaps 24 may include an elongated member 46 that may be bent along with the flaps 24 and retain a nonlinear shape without returning to its original position shown by after an external pressure is removed. The elongated member 46 may retain the flaps 24 in various open positions or in a closed position while one or more of the flaps 24 is unattached from the retaining device 38. In some examples, the elongated member 46 may be configured as a flexible wire-type material (e.g., copper wire) in one or more hems 48 of the flaps 24 to allow for adjustment in the size and shape of the window 22 that is uninhibited by the flaps 24. For example, as illustrated in FIG. 5, the elongated member 46 is disposed along a top portion, a side portion, and a bottom portion of each of the first and second flaps 24*a*, 24*b*. By including elongated member 46 along more than one side and in varying directions, may increase the flaps 24 strength against inadvertent external forces such as, but not limited to, vibration or air flow that may otherwise act to change the position of the flaps 24 from its desired position.

The elongated member 46 coupled with the flaps 24 can be composed of any material that is flexible enough to achieve the nonlinear position desired for the position of the flaps 24, and has the physical properties allowing the flaps 24 to retain a nonlinear position. Some illustrative and non-limiting examples of possible materials are copper or aluminum wires, bands, or strips. Other possibilities include metal or non-metal wires, bands, or strips that have the proper physical characteristics to flex and retain the position of the flaps 24. Further, different combinations of quantities and positions of the elongated members 46 can be used. Varying the location of, the distance between, the percentage of, and the length of the elongated member(s) 46 along the length of the various portions of the flaps 24 will allow many alternative retention strengths and ability to position the flaps 24. There is an infinite number of combinations and positions of the flexible elongated member(s) 46 in the flaps 24. The combination of quantity and position of the flexible elongated member(s) 46 appropriate for the desired application will depend on the design characteristics of the flaps 24, such as degree of bend desired, strength of bend desired, etc. Generally, the more elongated member(s) 46 used, the greater length of the elongated member 46 inserted or embedded, and the closer the elongated member 46 spacing is, the stronger the position retention of the flap 24 may be. In addition, the elongated member(s) 46 may additionally or alternatively be positioned within an interior and/or and exterior portion of the shelter assembly 10 that surrounds the window 22. Moreover, the shelter assembly 10 can include any number of windows that may include any type of elongated member and each window may include as many flaps as desired. For example, the shelter assembly 10, or each window 22, may include 0-6 flaps 24, or more, without departing from the scope of the present disclosure.

In operation, the flaps 24 may be moved from a closed position to an open position thereby increasing a hunter's visibility outwards from the shelter 10. The flaps 24 may be maintained in the open position by the retaining devices 38 and/or the elongated member 46. In some instances, an arrow, bullet or other projectile may be fired from within the enclosure through the window 22, whereby the projectile punctures the window 22 and/or the one or more flaps 24, which may be readily puncturable by a projectile. Furthermore, because the flaps 24 can be manufactured of inexpensive and disposable materials, after a flap 24 has been penetrated by a projectile or worn for any reason, it may be easily removed by separating the flap 24 from the cover 14 and coupling a new or undamaged flap 24 to the cover 14 in place of the removed flap 24. By removably coupling the flaps 24 to the cover 14, the replacement of a punctured flap 24 may be done quickly, without the need for any tools, and without significant expense. In some embodiments, the shelter 10 may include multiple sets of flaps 24, to provide readily available replacement flaps 24. In some embodiments, a second set of flaps 24 may have a different camouflage pattern from a first set of flaps 24, enabling a user to alter the appearance of the shelter 10, such as when the shelter 10 is moved from one environment to a different environment. It will also be recognized that the door 20 and/or any other component of the shelter 10 may include any feature described herein without departing from the scope of the present disclosure. For example, the door 20 may include the fastening assembly 36, the retaining device 38 and/or the elongated member 46.

The collapsible shelter of the present disclosure may offer a variety of advantages. For instance, use of the collapsible shelter provided herein may allow for each of the legs of the frame to be vertically adjusted based on the terrain in which the shelter is used. A cover may be disposed over the frame and include an exterior layer thereon. The exterior layer and/or the cover may include a camouflage pattern thereon, which may be three-dimensional. The exterior layer may be removably attached to the cover such that various exterior layers may be used based on the environment surrounding the shelter. The cover may also define one or more windows. One or more flaps may be removably coupled with the cover and at least partially preclude visibility through the window. The flaps may include a retaining device, which may be in the form of a plurality of snaps, to retain the flaps in an engaged position relative to one another and/or relative the cover. One or more of snaps may be configured as a two-way snap that engages another flap in a closed position and the cover in the open position on two opposing sides of the two-way snap. Moreover, an elongated member may be disposed within the flap for retaining the flap in various, bent positions. The shelter may include any or all of these features while still being manufactured at costs that are less than other shelters available on the market.

It will be understood by one having ordinary skill in the art that construction of the described invention and other components is not limited to any specific material. Other examples of the invention disclosed herein may be formed from a wide variety of materials unless described otherwise herein.

For purposes of this disclosure, the term "coupled" (in all of its forms: couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

Furthermore, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected" or "operably coupled" to each other to achieve the desired functionality, and any two components capable of being so associated can also be viewed as being "operably couplable" to each other to achieve the desired functionality. Some examples of operably couplable include, but are not limited to, physically mateable and/or physically interacting components and/or wirelessly interactable and/or wirelessly interacting components and/or logically interacting and/or logically interactable components.

It is also important to note that the construction and arrangement of the elements of the examples as shown is illustrative only. Although only a few examples of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system might be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary examples without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. A collapsible shelter comprising:

a frame;

a cover disposed over the frame and defining a window;

first and second flaps each operably coupled with the cover and configured to extend over separate portions of the window;

a retaining device having a first portion disposed on the first flap and a second portion disposed on the second flap, the first and second portions configured to engage one another; and an elongated member disposed within the first and second flaps and configured to retain the first and second flaps in a non-linear position;

wherein the retaining device further includes a third portion operably coupled with the cover;

wherein the first portion of the retaining device includes a two-way snap configured to couple with the second and third portions on opposing sides thereof.

2. The collapsible shelter of claim 1, further comprising:

a fastening assembly coupling each of the first and second flaps to the cover on an opposing side of each respective flap from the first and second portions of the retaining device.

3. The collapsible shelter of claim 2, wherein the fastening assembly couples each of the first and second flaps to opposing sides of the window.

4. The collapsible shelter of claim 2, wherein the fastening assembly couples each of the first and second flaps to an interior surface of the cover.

5. The collapsible shelter of claim 1, wherein the first portion of the retaining device is configured to couple with the second portion to place the first flap in a closed position and with the third portion to place the first flap in an open position.

6. The collapsible shelter of claim 1, wherein the elongated member is configured as a wire disposed within a hem of the first or second flap.

7. A collapsible shelter comprising:

a cover disposed over a frame, the cover defining a window;

a first flap operably coupled with the cover through a fastening assembly;

a retaining device configured to maintain the first flap in respective open and closed positions; and a bendable, elongated member disposed within the first flap and configured to retain the first flap in a substantially defined position;

wherein the fastening assembly is configured as a magnet, wherein a first section of the magnet is disposed within the first flap and a second section is secured on the cover.

8. The collapsible shelter of claim 7, further comprising:

an exterior layer disposed on the first flap and having a camouflage pattern thereon.

9. The collapsible shelter of claim 7, further comprising:

an exterior layer disposed on the cover and including a Ghillie pattern.

10. The collapsible shelter of claim 7, wherein the frame includes one or more vertically adjustable legs.

11. The collapsible shelter of claim 7, further comprising a second flap, wherein the first flap covers a first portion of the window and the second flap covers a second, different portion of the window.

12. The collapsible shelter of claim 7, wherein the first flap and at least a portion of the cover include an exterior layer having a common camouflage pattern thereon.

13. A shelter comprising:

a cover disposed over a frame, the cover defining a window;

first and second flaps operably coupled with the cover through a fastening assembly; and a bendable, elongated member disposed within the first and second flaps and configured to retain the first and second flaps in a substantially defined position;

wherein the fastening assembly is configured as a magnet, wherein a first section of the magnet is disposed within the first flap and a second section is secured on the cover.

14. The shelter of claim 13, further comprising:

a retaining device configured to maintain the first and second flaps in respective open and closed positions.

15. The shelter of claim 13, wherein the frame includes one or more vertically adjustable legs and one or more cross beams that interconnect the legs.

16. The shelter of claim 13, further comprising:

an exterior layer disposed on the cover and including a Ghillie pattern.

17. The shelter of claim 13, wherein the fastening assembly removably couples the first and second flaps to the cover through a first section on the first and second flaps and a second section on the cover.

* * * * *